US010524503B2

(12) United States Patent
Florack et al.

(10) Patent No.: US 10,524,503 B2
(45) Date of Patent: Jan. 7, 2020

(54) SLIDEABLE EXTINGUISHER

(71) Applicant: Philip Morris Products S.A., Neuchatel (CH)

(72) Inventors: Dionisius Elisabeth Antonius Florack, Le Landeron (CH); Evan Jochnowitz, Neuchatel (CH); Angelos Kolyris, St-Sulpice (CH); Keethan Dasnavis Fernando, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/513,170

(22) PCT Filed: Sep. 28, 2015

(86) PCT No.: PCT/EP2015/072284
§ 371 (c)(1),
(2) Date: Mar. 22, 2017

(87) PCT Pub. No.: WO2016/050706
PCT Pub. Date: Apr. 7, 2016

(65) Prior Publication Data

US 2017/0303585 A1 Oct. 26, 2017

(30) Foreign Application Priority Data

Sep. 29, 2014 (EP) ..... 14186928

(51) Int. Cl.
*A24F 13/00* (2006.01)
*A24F 17/00* (2006.01)
(Continued)

(52) U.S. Cl.
CPC ..... *A24F 47/006* (2013.01); *A24D 1/10* (2013.01)

(58) Field of Classification Search
CPC ..... A24D 1/10; A24F 47/00; A24F 47/006; A24F 47/008
(Continued)

(56) References Cited

U.S. PATENT DOCUMENTS 2,923,647 A * 2/1960 Aghnides ..... A24D 1/00 131/336
4,121,597 A * 10/1978 Shin ..... A24D 1/047 131/235.1
(Continued)

FOREIGN PATENT DOCUMENTS

CN 101778578 A 7/2010
CN 103932390 A 7/2014
(Continued)

OTHER PUBLICATIONS

International Search Report and Written Opinion dated Dec. 18, 2015 in PCT/EP2015/072284, filed Sep. 28, 2015.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

A smoking article having a proximal end and a distal end is provided, including a combustible heat source disposed at the distal end; an aerosol-forming substrate downstream of the combustible heat source; a mouthpiece downstream of the aerosol-forming substrate and disposed at the proximal end; and a tubular element, which is slideable from a first position towards the distal end to a second position. In the second position, the tubular element at least partially extends over the combustible heat source and is configured to reduce the air supply to the combustible heat source. The tubular element is configured to modify a heat output of the
(Continued)

combustible heat source, and to control a resistance-to-draw of the smoking article by selectively covering air inlets.

13 Claims, 6 Drawing Sheets

(51) Int. Cl.
*A24F 25/00* (2006.01)
*A24F 47/00* (2006.01)
*A24D 1/10* (2006.01)

(58) Field of Classification Search
USPC ..... 131/194, 270, 329
See application file for complete search history.

(56) References Cited

U.S. PATENT DOCUMENTS

| | | | | |
|---|---|---|---|---|
| 4,776,355 | A | 10/1988 | Stevenson et al. | |
| 5,040,552 | A * | 8/1991 | Schleich | A24F 47/004 131/359 |
| 5,595,577 | A * | 1/1997 | Bensalem | A24B 15/165 131/194 |
| 5,992,420 | A * | 11/1999 | Moriyama | A24D 1/10 131/187 |
| 8,061,361 | B2 | 11/2011 | Maeder et al. | |
| 2009/0065011 | A1* | 3/2009 | Maeder | A24F 47/006 131/194 |
| 2013/0233329 | A1* | 9/2013 | Sebastian | A24F 47/004 131/329 |
| 2014/0106159 | A1 | 4/2014 | Riordan | |
| 2019/0000142 | A1* | 1/2019 | Lavanchy | A24F 47/006 |

FOREIGN PATENT DOCUMENTS

| | | | |
|---|---|---|---|
| DE | 25 37 334 | A1 | 3/1976 |
| JP | H06-046497 | U | 6/1994 |
| JP | 2000-4865 | A | 1/2000 |
| JP | 2000-502909 | A | 3/2000 |
| JP | 2010-535530 | A | 11/2010 |
| WO | WO 2009/022232 | A2 | 2/2009 |
| WO | WO 2013/072336 | A1 | 5/2013 |
| WO | WO 2013/104616 | A1 | 7/2013 |
| WO | WO 2013/120854 | A1 | 8/2013 |
| WO | WO 2015/022317 | A1 | 2/2015 |
| WO | WO 2015/022319 | A1 | 2/2015 |
| WO | WO 2015/022320 | A2 | 2/2015 |
| WO | WO 2015/022321 | A1 | 2/2015 |
| WO | WO 2015/028654 | A1 | 3/2015 |
| WO | WO 2015/181379 | A2 | 12/2015 |

OTHER PUBLICATIONS

Extended European Search Report dated Apr. 2, 2015 in Patent Application No. 14186928.9.

Combined Russian Office Action and Search Report dated Nov. 12, 2018 in Russian Patent Application No. 2017115173 (with English translation), 13 pages.

Chinese Office Action with English translation dated Apr. 8, 2019 in corresponding Chinese Patent Application No. 201580049823.6, (15 pages).

Japanese Office Action with English transiation dated Oct. 3, 2019 in corresponding Japanese Patent Application No. 2017-316863 (4 pages).

* cited by examiner

SLIDEABLE EXTINGUISHER

TECHNICAL FIELD

The present invention relates to a smoking article having a combustible heat source for heating an aerosol-forming substrate, and a component for modulating the heat of the combustible heat source.

DESCRIPTION OF THE RELATED ART

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, such as tobacco. The aerosol-forming substrate may be located within, around or downstream of the combustible heat source. For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. During smoking, volatile compounds are released from the aerosol-forming substrate by heat transfer from the combustible heat source and entrained in air drawn through the smoking article. As the released compounds cool, they condense to form an aerosol that is inhaled by the user.

Smoking articles which include a combustible fuel element or heat source may have a combustion zone or zone of heating that is larger, more dense, and not as readily extinguished by crushing or "stubbing out" the heat source compared to a conventional cigarette, in which tobacco is burnt or combusted to heat and release volatile compounds from the tobacco. Such smoking articles may have a heat source that contains significantly more energy in the form of heat than found in the combustion zone of a conventional cigarette. Consequently, such smoking articles may require more effort to extinguish or to remove sufficient heat to facilitate disposal.

It would be desirable to provide an improved extinguisher for smoking articles, particularly one which may be used with smoking articles that include a combustible fuel element or heat source. In particular, it would be desirable to provide a smoking article having an extinguisher which is both simple to manufacture and use. In addition, it would be desirable to provide an extinguisher which can be readily kept unobtrusively together with the smoking article so as to avoid the need of having a separate element to extinguish the smoking article after use.

SUMMARY

According to one aspect of the present invention, there is provided a smoking article having a proximal end and a distal end. The smoking article comprises: a combustible heat source positioned at the distal end of the smoking article; an aerosol-forming substrate downstream of the combustible heat source; a mouthpiece downstream of the aerosol-forming substrate and positioned at the proximal end of the smoking article; and a tubular element, which is slideable from a first position towards the distal end of the smoking article to a second position. In some examples of the invention, the positioning of the tubular element may, in use, modulate the heat of the combustible heat source. In the second position, the tubular element at least partially extends over the combustible heat source. In some examples, the tubular element in the second position acts to reduce the air supply to the combustible heat source. In some examples, the tubular element in the second position acts to restrict combustion of the heat source.

Providing such a tubular element, which is slideable, provides a simple to manufacture, simple to use, means of modulating the heat output of the combustible heat source. By covering the combustible heat source with the tubular element while the heat source is combusting or hot, a barrier is formed that may help prevent the heat source from igniting materials adjacent to the heat source. Thus, the heat source may be shielded by the tubular element until it has cooled to a sufficiently low temperature to significantly reduce or eliminate any potential risk associated with improper handling of the smoking article, such as the potential risk of igniting adjacent materials.

BRIEF DESCRIPTION OF THE DRAWINGS

Embodiments of the invention will now be further described, by way of example only, with reference to the accompanying drawings in which.

DETAILED DESCRIPTION

Figure 1:
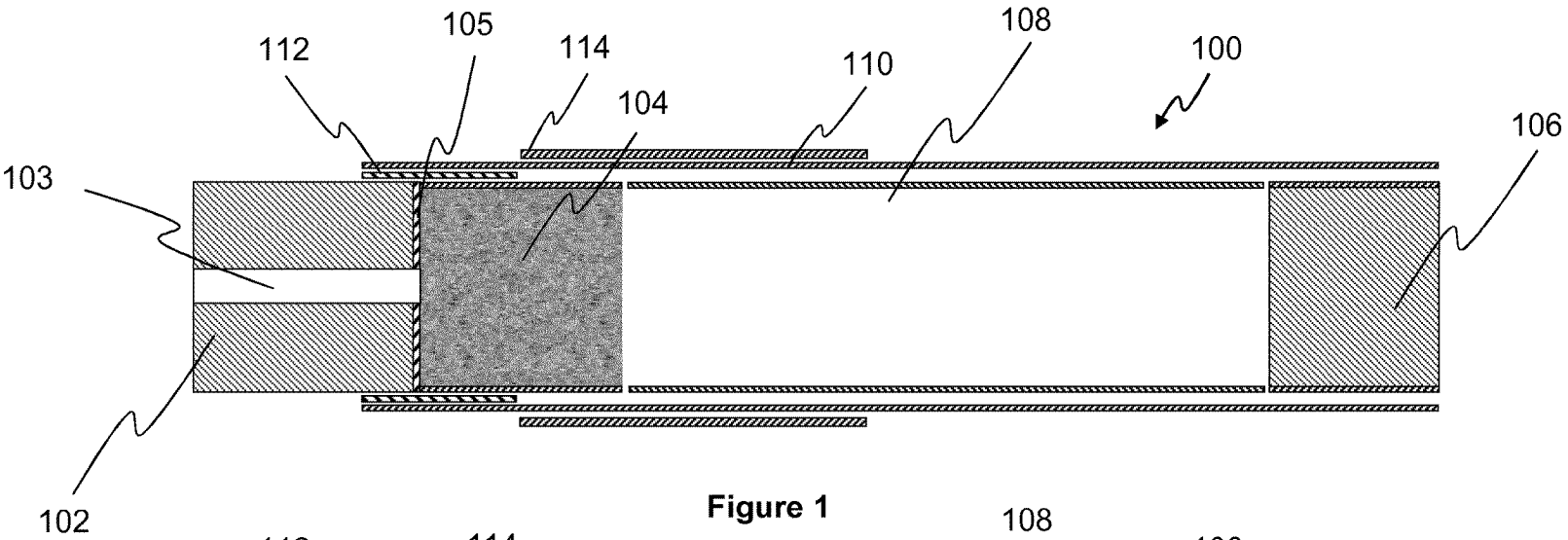
FIG. 1 shows a cross-sectional view of an embodiment of a smoking article according to the present invention.

In an aspect of the present invention, there is provided a smoking article having a proximal end and a distal end, comprising: a combustible heat source positioned at the distal end of the smoking article; an aerosol-forming substrate downstream of the combustible heat source; a mouthpiece downstream of the aerosol-forming substrate and positioned at the proximal end of the smoking article; and a tubular element, which is slideable from a first position towards the distal end of the smoking article to a second position for, in use, modulating the heat of the combustible heat source, wherein, in the second position, the tubular element at least partially extends over the combustible heat source to reduce the air supply to the combustible heat source.

Preferably, the tubular element is configured such that there is a frictional fit between the inner surface of the tubular element and the outer surface of the smoking article. Providing such a frictional fit may prevent the tubular element from sliding accidentally, and so positive action is required from the user to move the element away from the first position. The frictional fit may improve the ability of the slideable tubular element to modulate the heat output of the combustible heat source because it is less likely that the tubular element will move from the second position.

The tubular element is slideable from the first position to the second position. This enables the user to modulate the heat output of the combustible heat source by selectively covering only a portion of the combustible heat source, rather than sliding the tubular element fully to the second position. Such modulation enables the user to control the intensity of the smoking experience.

In the second position, in some examples, the slideable element preferably extends along substantially the full length of the combustible heat source. In some examples, the tubular element covers substantially all of the length of the combustible heat source. In some examples, the tubular element preferably extends past the distal end of the combustible heat source. In this position, the tubular element may act to reduce the air supply to the combustible heat source, for example to extinguish the heat source. Preferably, the tubular element is substantially impermeable to air. The gap between the external surface of the heat source and the internal surface of the tubular element is preferably less than about 2 mm, more preferably less than about 1 mm. With this small gap, there is restricted access of oxygen to the heat source as compared to when the heat source is free to burn without the tubular element. In addition, the emission of combustion gases from the heat source further restricts the flow of oxygen to the heat source because the small gap between the tubular element and the heat source reduces the mixing rate of the combustion gases with the surrounding air.

The tubular element may be lined with a heat reactive material. The heat reactive material may be arranged to deform in response to heat from the combustible heat source when the tubular element is in the second position. Deformation of the heat reactive material may be such that the tubular element fits tightly against the combustible heat source, for example to reduce the supply of air to the combustible heat source. Such an arrangement may enable the tubular element to substantially seal the combustible heat source from an air supply to reduce, even further, the time taken for the heat source to become cooled or extinguished. In addition, the heat reactive element may act as an improved thermal barrier between the heat source and the external surface of the tubular element. Therefore, the temperature of the external surface may be reduced.

The heat reactive material may comprise an intumescent material. The heat reactive material may comprise a heat-shrink material. Preferably, the heat-shrink material is configured to deform the tubular element to further reduce the supply of air to the combustible heat source.

As used herein, the term 'intumescent material' is used to describe a material that expands as a result of heat exposure, thus increasing in volume and decreasing in density.

The intumescent material may comprise any suitable material or materials. In certain embodiments, the intumescent material forms an insulating foam when exposed to heat from the combustible heat source of the smoking article. In one embodiment, the intumescent material comprises a carbon source, such as starch or one or more pentaerythritols (or other types of polyalcohol), an acid source, such as ammonium polyphosphate, a blowing agent such as melamine, and a binder, such as soy lecithin. In an alternative embodiment, the intumescent material comprises a mixture of sodium silicate and graphite such that a hard char foam may be produced when the intumescent material is exposed to heat from the combustible heat source of the smoking article.

The intumescent material may be applied as a heat reactive coating formed by applying one or more intumescent varnishes, paints, lacquers, or any combination thereof on an interior surface of the tubular element. For example, by brushing, rolling, dipping or spraying or by using intumescent paper or plastic-based sheet that is formed into the final shape of the tubular element by any known manufacturing processes, such as cutting, rolling and gluing systems. In one embodiment, the intumescent material is a latex solution applied by spraying.

The intumescent material may expand by any suitable amount when exposed to heat from the combustible heat source of the smoking article. Preferably, the intumescent material expands by a factor of between about 10 and about 100 times its original dimensions when exposed to heat. Where the intumescent material is applied as a heat reactive coating on an interior surface of the tubular element, preferably the thickness of the coating is from about 10 microns to about 100 microns and increases to from about 1 mm to about 2 mm when exposed to heat from the combustible heat source of the smoking article.

Alternatively, or in addition, the heat reactive material may comprise a heat shrink material. As used herein, the term 'heat shrink material' is used to describe a material that shrinks as a result of heat exposure.

In certain embodiments, the heat shrink material may be a mechanically expanded polymer layer which returns to its unexpanded dimensions as a result of heat exposure. For example, the heat shrink material may be manufactured from a thermoplastic material such as nylon, polyolefin, fluoropolymer (such as FEP, PTFE or Kynar), PVC, neoprene, silicone elastomer, Viton, or any combination thereof. In certain embodiments, the heat shrink material is a fluoroplastic Kynar with a shrink temperature of about 135° C. and a shrink ratio of about 2:1. In such embodiments, the fluoroplastic Kynar may be provided as a layer of the material used to form the tubular element.

In certain embodiments, the heat shrink material is applied as a heat reactive coating on an inner surface of the tubular element. In such embodiments, the coating may be applied by any suitable method. For example, the coating may be applied as a sheet or film which is adhered to the tubular element, for example by gluing or welding. The heat reactive coating may only be adhered to the downstream end of the tubular element, such that the amount by which the opening of the tubular element is deformed is increased to more effectively surround or enclose the combustible heat source of the smoking article. It may also allow a layer of air to form between the tubular element and the combustible heat source to improve the thermal insulating properties of the tubular element.

Alternatively, or in addition, the tubular element may be lined with non-combustible material. The non-combustible material may be at least one of: a metal; a metal oxide; a ceramic; and a stone. Further, the non-combustible material may be graphite. In some examples, the non-combustible material is aluminium.

During use of the heated smoking article, the combustible heat source may reach high temperatures. For example, a heat source of a heated smoking article may reach an average temperature of around 500° Celsius and in certain cases the temperature of the heat source may reach up to about 800° Celsius. Thus, the tubular element may comprise insulating material. The insulating material may reduce the risk of the user being exposed to high surface temperatures near the heat source on the heated smoking article. Suitable thermally insulating materials have a low thermal conductivity or substantially no thermal conductivity. Suitable thermally insulating materials may include, for example, cardboards, foams, polymers or ceramic materials, or other materials that have a low thermal conductivity.

The tubular element may comprise heat-sensitive ink, such that, in use, the heat-sensitive ink indicates the temperature of the combustible heat source. The heat-sensitive ink, or thermochromatic pigments or materials change colour with respect to temperature. This has the advantage of providing a user with a visual cue of the temperature near the heat source on the smoking article. Furthermore, the use of a thermochromatic pigment or material may provide a simple visual indication of when the smoking article has reached a temperature that is low enough to be disposed of without additional precautionary measures.

The tubular element may be formed from a suitable barrier material such as a substantially non-combustible material or a substantially flame retardant material. Preferably, the barrier material is thermally stable in air at the highest temperature achieved by the heat source of the smoking article. Suitable barrier materials may, for example, include metallic materials, or ceramic materials.

The tubular element may comprise one or more materials that undergo a phase change when heated. The tubular element may comprise one or more materials that melt and extinguish the heat source by flowing over the heat source and eliminating or restricting oxygen supply to the heat source. The tubular element may comprise one or more materials that undergo an endothermic reaction or phase change and consume heat energy produced by the heat source, thereby cooling the heat source. The tubular element may comprise one or more materials that decompose when brought in contact with the heat source and produce a decomposition product that extinguishes the heat source. Examples of materials that may undergo a phase change when in proximity to the heat source include, for example, certain polymers and waxes.

The tubular element may comprise one or more materials selected from the group consisting of barrier materials, non-combustible materials, flame retardant materials, thermally conductive materials, thermally insulating materials, foam materials, phase-changing materials, metallic materials, and ceramic materials. For example, the tubular element may comprise one or more materials selected from the group consisting of non-combustible materials, flame-retardant materials, thermally conductive materials and thermally insulating materials.

In some embodiments, the tubular element may comprise a heat-reflective material which advantageously may modulate the heat radiating from the combustible heat source. As used herein the term 'heat reflective material' refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75% of incident radiation.

The tubular element may be formed from a composite material, such as a material comprising a plurality of layers. The layers of the composite material for the tubular element may be formed from two or more of the materials described herein. For example, the tubular element may be formed from material comprising an external insulating layer, a second layer of intumescent or heat reactive material, and an internal layer of non-combustible material.

The tubular element may reduce the emission of undesirable odours from the smoking article when in the second position. The tubular element may reduce the emission of odours by comprising a material which absorbs or adsorbs the odours. Alternatively, or in addition, the tubular element may comprise a heat-released flavour compound. The flavour compound may be a nanoparticle formed from a low melting point wax encapsulating the flavour compound. The flavour compound is preferably volatile such that it is released into the atmosphere on activation of the nanoparticle.

The outer surface of the smoking article, in the region beneath the tubular element when the tubular element is in the first position, may have indicia, such that the indicia is only visible when the tubular element is in the second position. Thus, the user may be provided with relevant information, such as advice on how long to wait for the smoking article to reduce in temperature before disposing of the smoking article.

In one embodiment, the smoking article may further comprise a plurality of air inlets in the outer wrapper. In use, air drawn through the aerosol-forming substrate may enter the smoking article through the plurality of air inlets. In this embodiment, the tubular element is slidable from the first position to the second position such that the resistance to draw of the smoking article is controllable by selectively covering one or more of the air inlets. Such an arrangement provides a simple means of the user being able to configure the smoking article to their particular preferences. Furthermore, in this embodiment, the tubular element may comprise at least one air inlet. In this way, the resistance to draw may be controlled more precisely by selectively aligning the at least one tubular element air inlet with at least one of the plurality of air inlets provided on the smoking article.

The tubular element may be substantially continuously slideable from the first position to the second position. Alternatively, the outer surface of the smoking article may be provided with a plurality of protrusions such that an end face of the tubular element abuts a first protrusion when in the first position, and an end face of the tubular element abuts a second protrusion when in the second position.

In an alternative embodiment, the tubular element may be rotatable about the longitudinal axis of the smoking article. The tubular element is preferably rotatable such that in a first angular position the smoking article has a first resistance-to-draw, and in a second angular position the smoking article has a second resistance-to-draw. The resistance-to-draw can thus be controlled by the user rotating the tubular element. Preferably, in the first angular position, air inlets on the tubular element align with a first set of air inlets in the outer wrapper of the smoking article, and, in the second angular position, the air inlets on the tubular element align with a second set of air inlets in the outer wrapper of the smoking article.

The plurality of air inlets are preferably provided in the outer wrapper in the region of the aerosol-forming substrate. The plurality of air inlets are preferably provided around the periphery of the smoking article. The air inlets may be provided in one or more rows, each row extending around the circumference of the smoking article.

The resistance-to-draw (RTD) of a smoking article refers to the static pressure difference between the two ends of the specimen when it is traversed by an air flow under steady conditions in which the volumetric flow is 17.5 milliliters per second at the output end. The RTD of a specimen can be measured using the method set out in ISO Standard 6565: 2002.

The smoking article may further comprise a transfer element between the aerosol-forming substrate and the mouthpiece. In the first position, the tubular element is positioned over the transfer element.

The inner surface of the tubular element may comprise one or more protrusions arranged such that, when the tubular element is in the second position, the one or more protrusions resist movement of the tubular element towards the proximal end of the smoking article. This may help to prevent the tubular element from becoming accidentally dislodged from the second position by ensuring that the tubular element only moves under positive action from the user. In such embodiments, the one or more protrusions may comprise a folded flap at a distal end of the tubular element, the folded flap extending at least partially towards the proximal end of the smoking article. This may provide a simple and easy to manufacture protrusion to resist movement of the tubular element. For example, when the tubular element is moved from the first position to a second position in which it overlies the combustible heat source of the smoking article, the free end of the flap may abut against a projection or recess in the outer surface of the smoking article, such as the junction between the combustible heat source and the remainder of the smoking article, to resist downstream movement of the tubular element. This may prevent the tubular element from becoming accidentally dislodged from the second position. Additionally, the folded flap may be biased against the smoking article to increase the resistance of the folded flap to movement of the tubular element. For example, the folded flap may be biased towards the smoking article simply due to deformation of the folded flap relative to the remainder of the tubular element. Alternatively, or in addition, the one or more protrusions may comprise a folded flap at a proximal end of the tubular element, the folded flap extending at least partially towards the distal end of the smoking article.

In some examples, the protrusions on the inner surface of the tubular element comprise a inner surface comprise a folded flap at a distal end of the tubular element, the folded flap extending at least partially towards the proximal end of the smoking article, and a folded flap at a proximal end of the tubular element, the folded flap extending at least partially towards the distal end of the smoking article. In such examples, the folded flap at the proximal end of the tubular element, or "proximal flap", may be folded along a line or weakness, such as perforations, in the tubular element and glued to the smoking article. The proximal flap may then be severed from the rest of the tubular element along the line of weakness to allow the tubular element to be moved along the length of the smoking article.

The combustible heat source is preferably a solid heat source, and may comprise any suitable combustible fuel including, but not limited to, carbon and carbon-based materials containing aluminium, magnesium, one or more carbides, one or more nitrides and combinations thereof. Solid combustible heat sources for heated smoking articles and methods for producing such heat sources are known in the art and described in, for example, U.S. Pat. Nos. 5,040,552 and 5,595,577. Typically, known solid combustible heat sources for heated smoking articles are carbon-based, that is they comprise carbon as a primary combustible material.

The combustible heat source may be a carbonaceous combustible heat source. As used herein, the term 'carbonaceous' is used to describe a combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the combustible heat source.

The combustible heat source is preferably a blind combustible heat source. As used herein, the term 'blind' describes a heat source that does not comprise any air flow channels.

In certain embodiments of the invention, the combustible heat source comprises at least one longitudinal airflow channel, which provides one or more airflow pathways through the heat source. The term "airflow channel" is used herein to describe a channel extending along the length of the heat source through which air may be drawn through the smoking article for inhalation by a user. Such heat sources including one or more longitudinal airflow channels are referred to herein as "non-blind" heat sources.

The diameter of the at least one longitudinal airflow channel may be between about 1.5 mm and about 3 mm, more preferably between about 2 mm and about 2.5 mm. The inner surface of the at least one longitudinal airflow channel may be partially or entirely coated, as described in more detail in WO-A-2009/022232.

An aspect of the invention also provides the tubular element independently. The tubular element may have one or more of the features described herein individually or in any appropriate combination. While the tubular element described herein finds particular application for use in relation to an aerosol generating article in which the aerosol-forming substrate is heated and not burnt, the tubular element may also be used in other applications, for example as a heat modulator or extinguisher in relation to a conventional lit-end cigarette. Where the tubular element is used with a conventional lit-end cigarette, to modulate or extinguish, the tubular element will be slid along the cigarette and arranged to partly or fully extend over the lit end of the tobacco volume.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise one or more aerosol formers. Examples of suitable aerosol formers include, but are not limited to, glycerine and propylene glycol.

In some embodiments, the aerosol-forming substrate is a rod comprising a tobacco-containing material.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The smoking article may comprise a transfer section or transfer element. Such an element may take the form of a hollow tube that is located downstream of an aerosol-forming substrate.

The terms "upstream" and "downstream" as used herein refer to relative positions along a smoking article defined with reference to the direction in which air is drawn through the smoking article by a user. Thus, the first end, or mouth end, is downstream from the second end, or distal end.

Elements forming the smoking article are preferably assembled by means of a suitable wrapper, for example a cigarette paper. A cigarette paper may be any suitable material for wrapping components of a smoking article in the form of a rod. The cigarette paper needs to grip the component elements of the smoking article when the article is assembled and hold them in position within the rod. Suitable materials are well known in the art.

The smoking article may be substantially cylindrical in shape. The smoking article may be substantially elongate. The smoking article has a length and a circumference substantially perpendicular to the length.

The aerosol-forming substrate may be substantially cylindrical in shape. The aerosol-forming substrate may be substantially elongate. The aerosol-forming substrate also has a length and a circumference substantially perpendicular to the length. The aerosol-forming substrate may be located in the smoking article such that the length of the aerosol-forming substrate is substantially parallel to the airflow direction in the smoking article.

The transfer section or element may be substantially elongate.

The smoking article may have any desired length. For example, the smoking article may have a total length of between approximately 65 mm and approximately 100 mm.

The smoking article may have any desired external diameter. For example, the smoking article may have an external diameter of between approximately 5 mm and approximately 12 mm.

The mouthpiece may comprise a filter. For example, the mouthpiece may comprise a filter plug having one or more segments. Where the mouthpiece comprises a filter plug, preferably the filter plug is a single segment filter plug. The filter plug may comprise one or more segments comprising cellulose acetate, paper or other suitable known filtration materials, or combinations thereof. Preferably, the filter plug comprises filtration material of low filtration efficiency.

The smoking article may be circumscribed by an outer wrapper of, for example, cigarette paper, which has low air permeability. Alternatively or in addition, the mouthpiece may be circumscribed by tipping paper.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

FIG. 1 shows a cross-sectional view of a smoking article according to one embodiment of the present invention. The smoking article 100 comprises a combustible heat source 102, an aerosol-generating substrate 104, a mouthpiece 106, and an elongate expansion chamber 108 in abutting coaxial alignment, which are overwrapped in an outer wrapper of cigarette paper 110. The combustible heat source 102 is cylindrical. The combustible heat source 102 comprises a central airflow channel 103 that extends longitudinally through the combustible heat source and a non-combustible, gas-resistant, barrier coating 105. A gas-resistant, heat resistant, second barrier coating (not shown) is provided on the inner surface of the central airflow channel 103. The aerosol-generating substrate 104 is located immediately downstream of the combustible heat source 102 and comprises a cylindrical plug of homogenised tobacco material comprising, for example, glycerine as aerosol former and circumscribed by filter plug wrap. A heat-conducting element 112, consisting of a tube of aluminium foil, surrounds and is in contact with a rear portion of the combustible heat source 102 and an abutting front portion of the aerosol-generating substrate 104. The elongate expansion chamber 108 is located downstream of the aerosol-generating substrate 104 and comprises a cylindrical open-ended tube of cardboard. The mouthpiece 106 is located downstream of the expansion chamber 108 and comprises a cylindrical plug of cellulose acetate tow circumscribed by filter plug wrap. All of the embodiments described with reference to FIGS. 1 to 5 comprise a smoking article having these features, and where the same features are present like reference numerals have been used.

In use, the user ignites the combustible heat source which heats the aerosol-forming substrate to produce an aerosol. When the user inhales on the mouthpiece 106 air is drawn through the aerosol-forming substrate 104 through air inlet holes (not shown), through the expansion chamber 108, through the mouthpiece 106 and into the users mouth.

The smoking article of FIG. 1 further comprises a tubular element 114 which is slideable along the outer surface of the smoking article. FIG. 1 shows the tubular element in a first position, in which the user can light the combustible heat source and smoke the smoking article. The tubular element is a frictional fit over the outer wrapper of the smoking article such that it only moves under positive action from the user.

Figure 2:
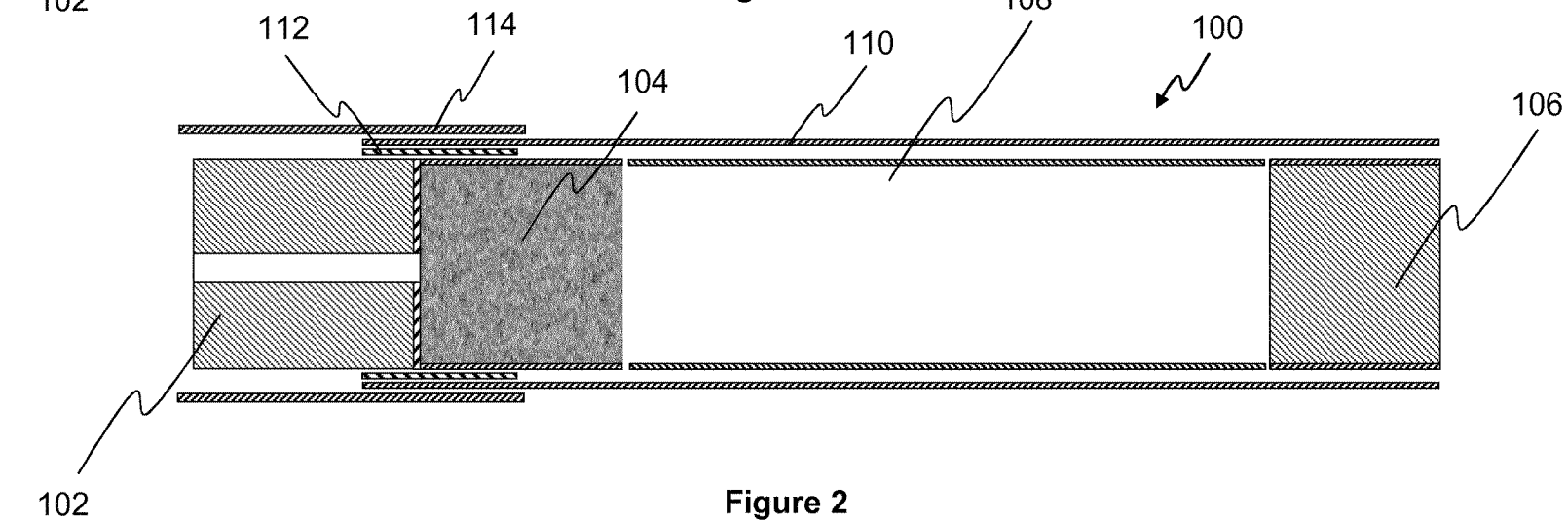
FIG. 2 shows a cross-sectional view of the smoking article of FIG. 1 in a second configuration.

In FIG. 2, the tubular element 114 is shown in a second position in which it overlies the combustible heat source 102. In this position, the tubular element sufficiently restricts the supply of oxygen to the combustible heat source that the heat source extinguishes, and thus cools down. The tubular element may be made from any suitable material, such as flame-retardant material. In this way, the user is provided with a simple and unobtrusive means of extinguishing the combustible heat source after use of the smoking article.

Figure 3:
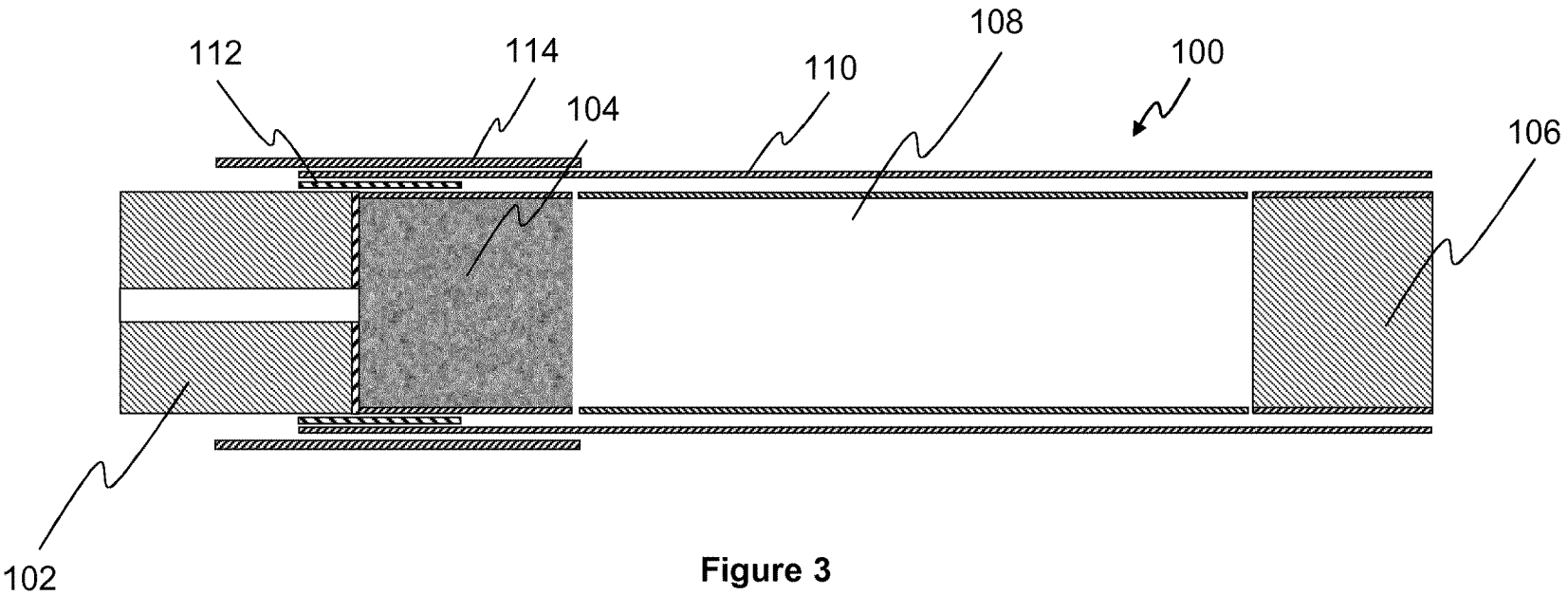
FIG. 3 shows a cross-sectional view of the smoking article of FIG. 1 in a further configuration.

In addition to extinguishing the heat source, the tubular element 114 may be moved to an intermediate position, as shown in FIG. 3 so as to partially cover the combustible heat source to decrease the combustion temperature by virtue of the partial restriction on the supply of oxygen to the heat source 102. The user is thereby provided with means of modulating the heat output of the heat source, and thus with means of controlling the smoking experience.

Further, the tubular element may be provided with a fragrance that may be evolved when the tubular element is heated by the combustible heat source. The fragrance may be released into the atmosphere and may act to mask any unpleasant odours released by the heat source as it is being extinguished. The fragrance may provide an air freshening effect by emitting pleasant odours and fragrances. Preferably the fragrance is sufficiently volatile that it swiftly evaporates after the tubular element is moved to the second position.

In preferred embodiments the fragrance may include one or more fragrance ingredient selected from the list consisting of Amyl Cinnamal, Amylcinnamyl Alcohol, Benzyl Alcohol, Benzyl Salicylate, Cinnamyl Alcohol, Cinnamal, Citral, Coumarin, Eugenol, Geraniol, Hydroxycitronellal, Hyroxymethylpentylcyclohexenecarboxaldehyde, lsoeugenol, Anisyl Alcohol, Benzyl Benzoate, Benyl Cinnamate, Citronellol, Farnesol, Hexyl Cinnamaldehyde 2-methyl-3-(4-tert-butylbenzyl)propionaldehyde, d-Limonene, Linalool, Methyl heptine carbonate, and 3-Methyl-4-(2,6,6-trimethyl-2-cyclohexen-1-yl)buten-2-one.

In the embodiment shown in FIGS. 1, 2 and 3, the tubular element may comprise an intumescent material, or heat-shrink material which reacts to the heat of the combustible heat source to at least partially close the open end of the tubular element to further restrict the supply of oxygen to the heat source. In addition to yet further restricting the supply of oxygen, the at least partially closed end of the tubular element may provide a physical barrier between the heat source and any external materials.

Figure 4:
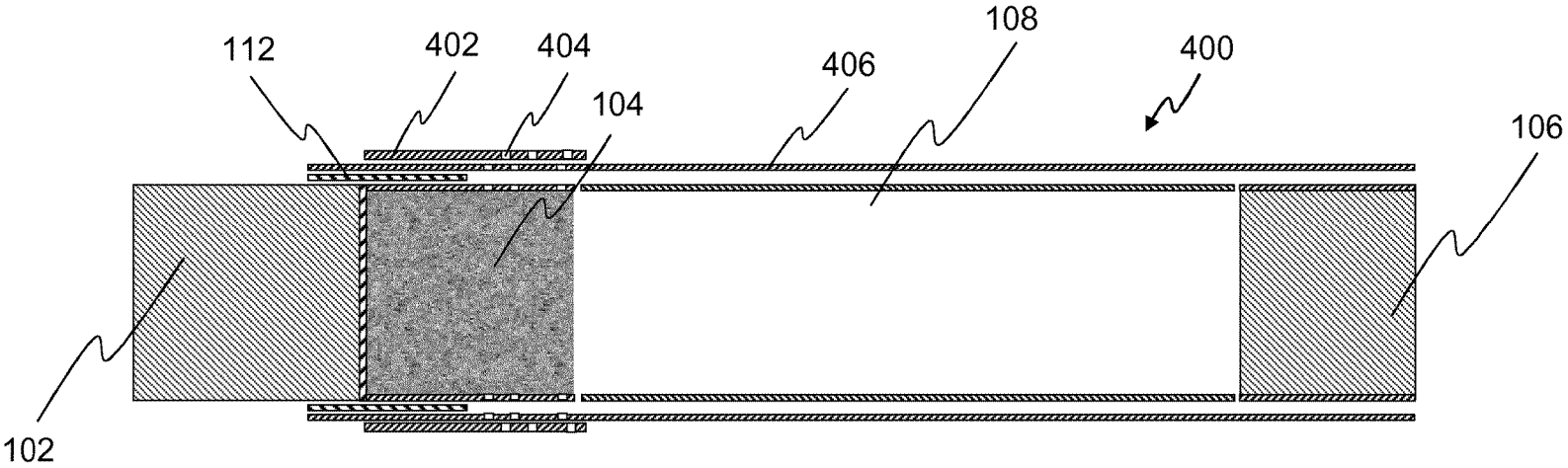
FIGS. 4 and 5 show a cross-sectional view of a further embodiment of a smoking article according to the present invention having adjustable resistance-to-draw.
Figure 5:
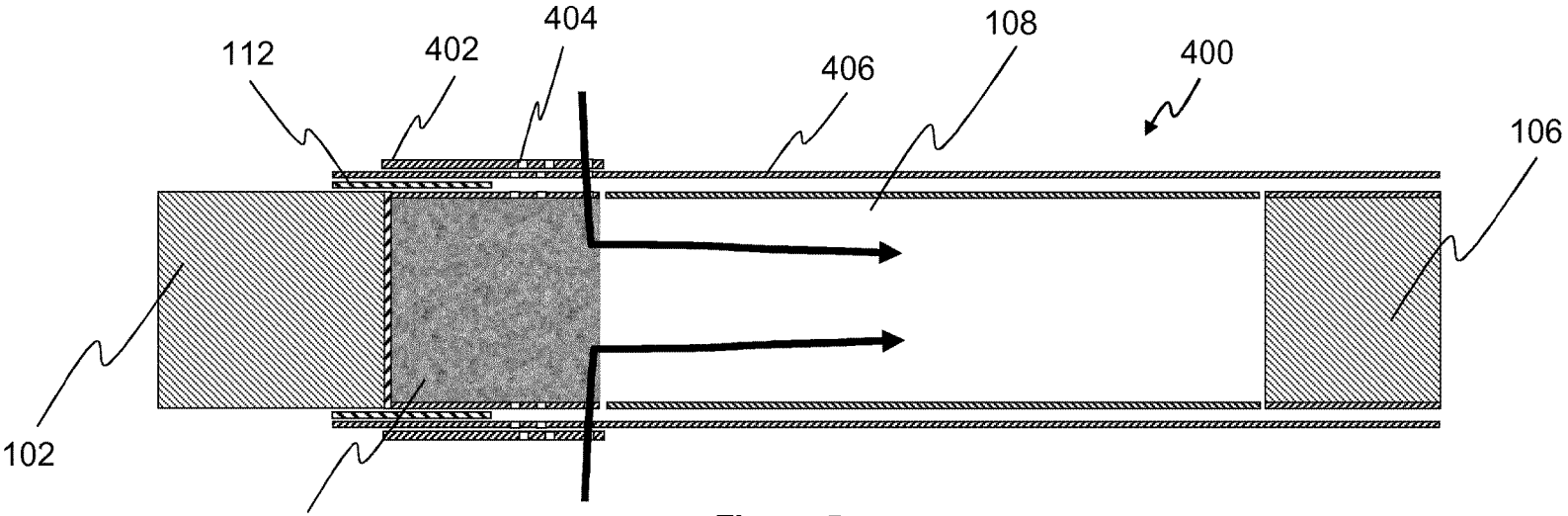

FIGS. 4 and 5 show a further embodiment of a smoking article 400. The tubular element 402 operates in the same way as described with reference to FIGS. 1, 2 and 3, but in addition is provided with air inlets 404. Corresponding air inlets are provided in the wrapper of the smoking article adjacent the aerosol-forming substrate. The tubular element can be moved from the first position as shown in FIG. 4 to the position as shown in FIG. 5. In the first position, the air inlets in the tubular element are not aligned with the air inlets in the wrapper 406 of the smoking article, and thus the resistance-to-draw of the smoking article is relatively high. The air inlets are provided in such a way that the user can progressively align the air inlets as the tubular element is moved from the first position towards the distal end of the smoking article. In this way, the user is provided with means of controlling the resistance-to-draw of the smoking article. In FIG. 5, the air flow path created through the aligned air inlets is shown by the arrows. As will be appreciated, when the user moves the tubular element yet further towards the distal end of the smoking article, further air inlets will become aligned thus yet further reducing the resistance-to-d raw.

Figure 6:
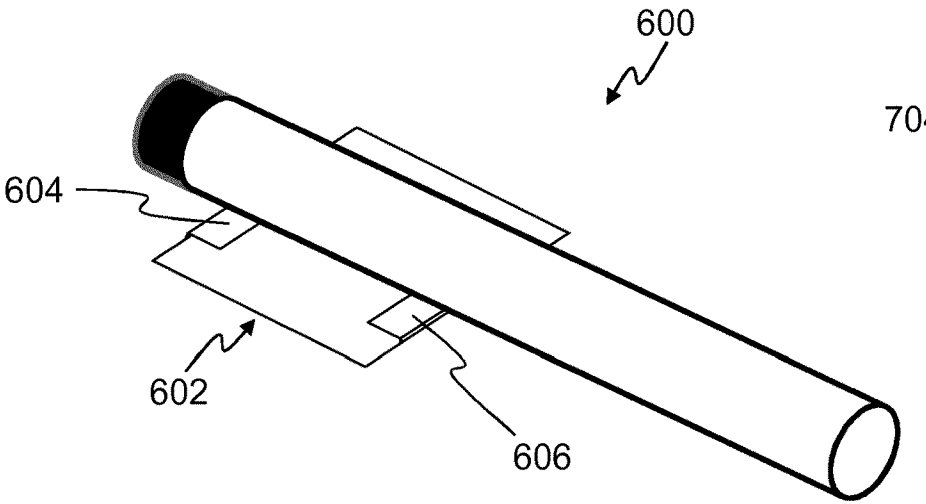
FIG. 6 shows a perspective view of a smoking article according to the present invention with an alternative configuration of tubular element, the tubular element being shown in the unwrapped condition, for clarity.

FIG. 6 shows a further embodiment of a smoking article 600 having a tubular element 602 which is shown, for clarity, in an unwrapped condition. As with the previous examples, the tubular element 602 extends around the smoking article and is slideable along the outer surface of the smoking article. The tubular element 602 comprises folded flaps 604, 606 at its distal and proximal ends. The distal and proximal flaps 604, 606 may be arranged to increase the frictional force between the tubular element 602 and the outer wrapper of the smoking article 600 such that the tubular element 602 only moves under positive action from the user.

The distal flap 604, at the distal end of the tubular element, extends at least partially towards the proximal end of the smoking article 600. That is, the distal flap 604 extends in a direction having a downstream component. In this example, the distal flap 604 extends in the proximal direction such that it is substantially parallel to the longitudinal axis of the smoking article. When the tubular element 602 is moved from a first position, as shown in FIG. 6, to a second position in which it overlies the combustible heat source of the smoking article 600, the free end of the distal flap 604 may abut against a projection or recess in the outer surface of the smoking article 600, such as the junction between the combustible heat source and the remainder of the smoking article 600, to resist downstream movement of the tubular element 602. In this manner, the distal flap 604 acts as a protrusion on the inner surface of the tubular element 602 which is arranged such that, when the tubular element is in the second position, the protrusion resists movement of the tubular element towards the proximal end of the smoking article. This may prevent the tubular element 602 from becoming accidentally dislodged from the second position.

The proximal flap 606, at the proximal end of the tubular element, extends at least partially towards the distal end of the smoking article 600. That is, the proximal flap 606 extends in a direction having an upstream component. In this example, the proximal flap 606 extends in the distal direction such that it is substantially parallel to the longitudinal axis of the smoking article. As the distal flap 604 is located between the smoking article and the main body of the tubular element 602, a small gap may be formed between the tubular element 602 and the smoking article downstream of the distal flap 604. The proximal flap 606 may act to close this gap and ensure that proximal end of the tubular element 602 is in contact with the smoking article. By extending towards the distal end of the smoking article, the proximal flap 606 may also act to resist upstream movement of the tubular element 602 such that the tubular element only moves under positive action from the user. Although the tubular element 602 shown in FIG. 6 has both a distal and a proximal flap 604, 606, in other examples, one or both of the distal and proximal flaps 604, 606 may be omitted.

Figure 7:
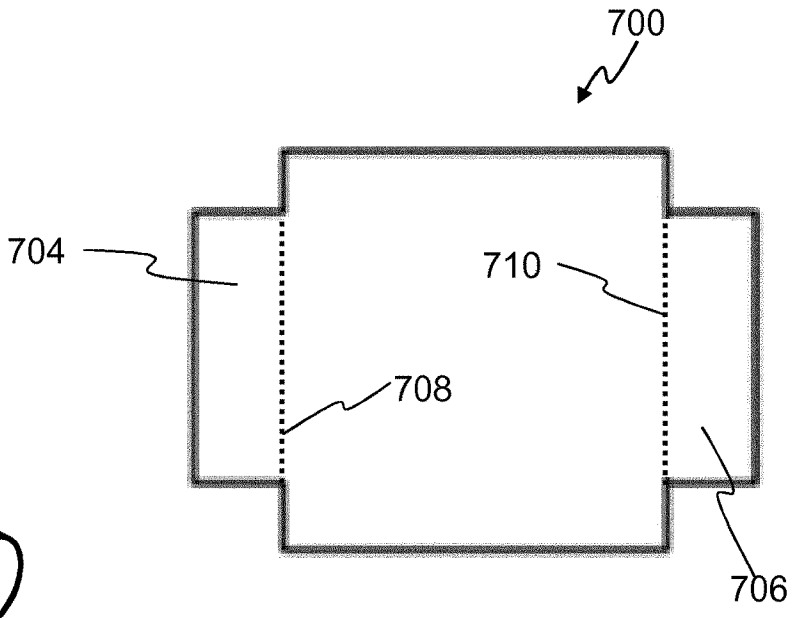
FIG. 7 shows a laminar blank for forming the tubular element of FIG. 6.

FIG. 7 shows a laminar blank 700 for forming the tubular element of FIG. 6. As shown, the laminar blank 700 comprises a main portion 702, a distal flap portion 704 for forming the distal flap and a proximal flap portion 706 for forming the proximal flap. The distal and proximal flap portions 704, 706 are integrally formed with the main portion 702 and are located at the distal and proximal ends of the main portion 702, respectively. The distal end portion 704 is connected to the main portion 702 along a first fold line 708. The proximal end portion 706 is connected to the main portion 702 along a second fold line 708. One or both of the first and second fold lines 708, 710 may be scored, perforated, or otherwise weakened to improve the ease of folding the distal and proximal flap portions 704, 706.

In this example, the second fold line 710 is formed from a line of perforations extending through the thickness of the laminar blank 700. With this arrangement, when assembled, the proximal flap may be glued to the smoking article to temporarily hold the tubular element against the smoking article and ensure that the tubular element does not move accidentally. To move the tubular element in an upstream direction, the user may apply an upstream force to the tubular element to break the perforations, leaving the proximal flap attached to the smoking article and the rest of the tubular element moveable along the length of the smoking article.

In some examples, the second fold line 710 is weakened, for example by scoring or perforating, while the first fold line 708 is not weakened. In such examples, when assembled to form the tubular element, the distal flap portion 704 may be biased towards the smoking article to a greater extent than the proximal flap, due to deformation of the laminar blank 700 at the first fold line 708. This may increase the frictional force exerted by the distal flap relative to the proximal flap. It may also increase the extent to which the distal flap abuts against obstructions on the outer surface of the smoking article to further resist downstream movement of the tubular element. Consequently, the force required to move the tubular element in the downstream direction may be greater than the force required to move the tubular element in the upstream direction. With such an arrangement, the likelihood of the tubular element being accidently dislodged from the second position may be increased without a corresponding increase to the force required from the user to move the tubular element to the second position from the first position.

In addition, in all of the above described embodiments, the smoking article may be supplied with the tubular element provided in the second position. In this way, the combustible heat source, which is typically a carbon based heat source, is protected from damage.

Example 1

A smoking article according to the invention with a blind combustible heat source and a tubular element formed from a co-laminated aluminum paper tube of 6.3 micron thickness was assembled. To test the performance of the tubular element, an infrared camera was used to measure the temperature of the heat source. The camera with a temperature sensitivity of from 150 degrees Celsius to 650 degrees Celsius was positioned at a distance of 0.85 metres from the smoking article and was set at a frame rate of 6.15 frames per second. In a first test, the temperature of the combustible heat source was measured without any puffs being taken from the smoking article. In a second test, the temperature of the combustible heat source was measured after 12 puffs with a puff volume of 35 ml, a puff duration of 2 seconds and a puff interval of 60 seconds using a smoking machine. Conditions for smoking and smoking machine specifications are set out in ISO Standard 3308 (ISO 3308:2000). The atmosphere for conditioning and testing is set out in ISO Standard 3402. In both tests, the temperature of the heat source was measured as the tubular element was slid from a first position, in which it was downstream of the heat source, to a second position, in which the distal end of the tubular element extended distally of the distal end of the smoking article.

Figure 8A:
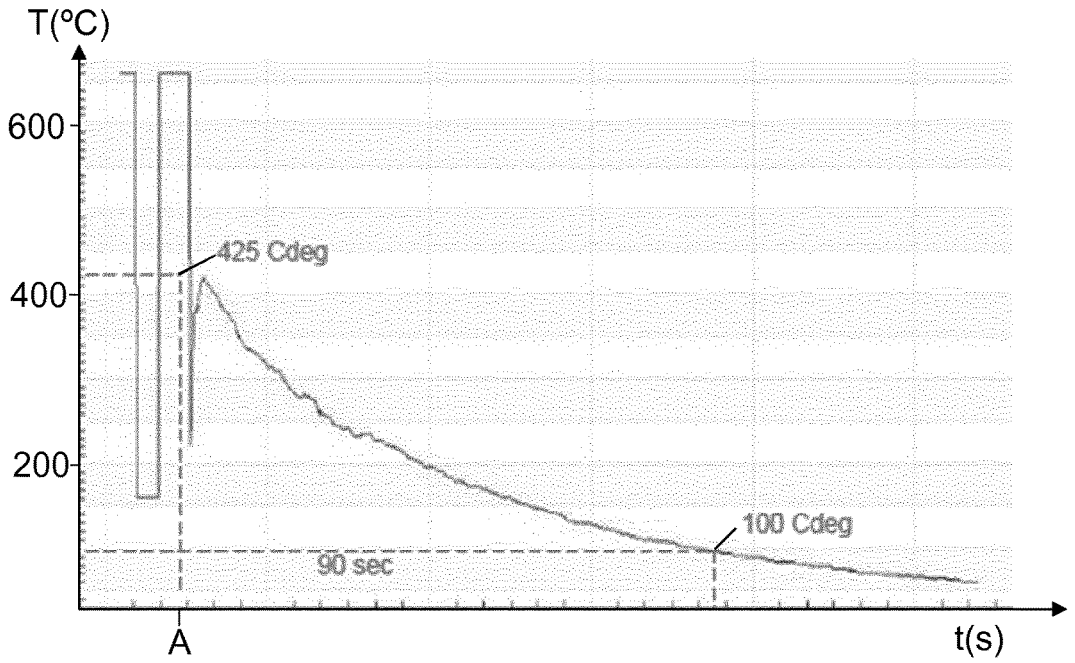
FIGS. 8A and 8B show graphs of temperature against time for a first example smoking article according to the invention.
Figure 8B:
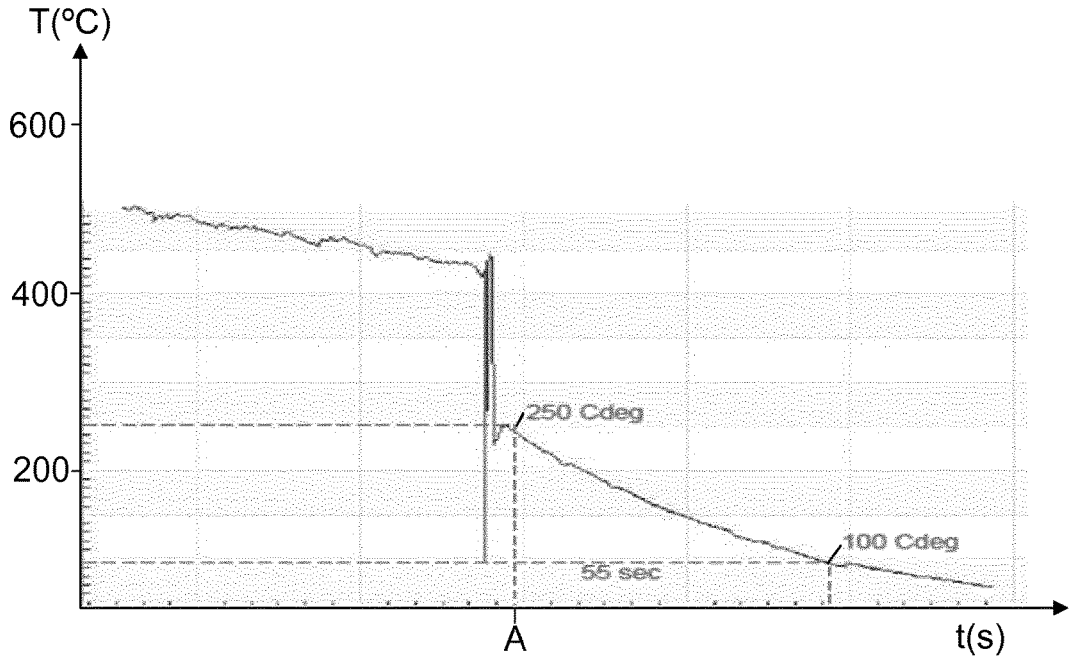

As shown in FIGS. 8A and 8B, the temperature of the combustible heat source upon lighting was above 700 degrees Celsius and outside of sensitivity range of camera. The temperature of the combustible heat source after 12 puffs was about between 400 and 450 degrees Celsius. In both tests a sharp decrease in temperature of the smoking article was observed upon sliding the extinguisher from first to second position, at time A. In the first test, the temperature of the heat source dropped to 100 degrees Celsius within 90 seconds upon sliding the tubular element to the second position. In the second test, the temperature of the heat source dropped to 100 degrees Celsius within 55 seconds upon sliding the tubular element to the second position.

Example 2

A smoking article according to the invention with a blind combustible heat source and a tubular element formed from a co-laminated aluminum paper tube of 6.3 micron thickness was assembled. The smoking article of example 2 differed from that of example 1 in that the tubular element further included a coating of Sika® Pyroplast® ST-100, a water based intumescent paint, on its inner surface. To test the performance of the tubular element, an infrared camera was used to measure the temperature of the heat source. The camera with a temperature sensitivity of from 150 degrees Celsius to 650 degrees Celsius was positioned at a distance of 0.85 metres from the smoking article and was set at a frame rate of 6.15 frames per second. In a first test, the temperature of the combustible heat source was measured without any puffs being taken from the smoking article. In a second test, the temperature of the combustible heat source was measured after 12 puffs with a puff volume of 35 ml, a puff duration of 2 seconds and a puff interval of 60 seconds using a smoking machine. Conditions for smoking and smoking machine specifications are set out in ISO Standard 3308 (ISO 3308:2000). The atmosphere for conditioning and testing is set out in ISO Standard 3402. In both tests, the temperature of the heat source was measured as the tubular element was slid from a first position, in which it was downstream of the heat source, to a second position, in which the distal end of the tubular element extended distally of the distal end of the smoking article.

Figure 9A:
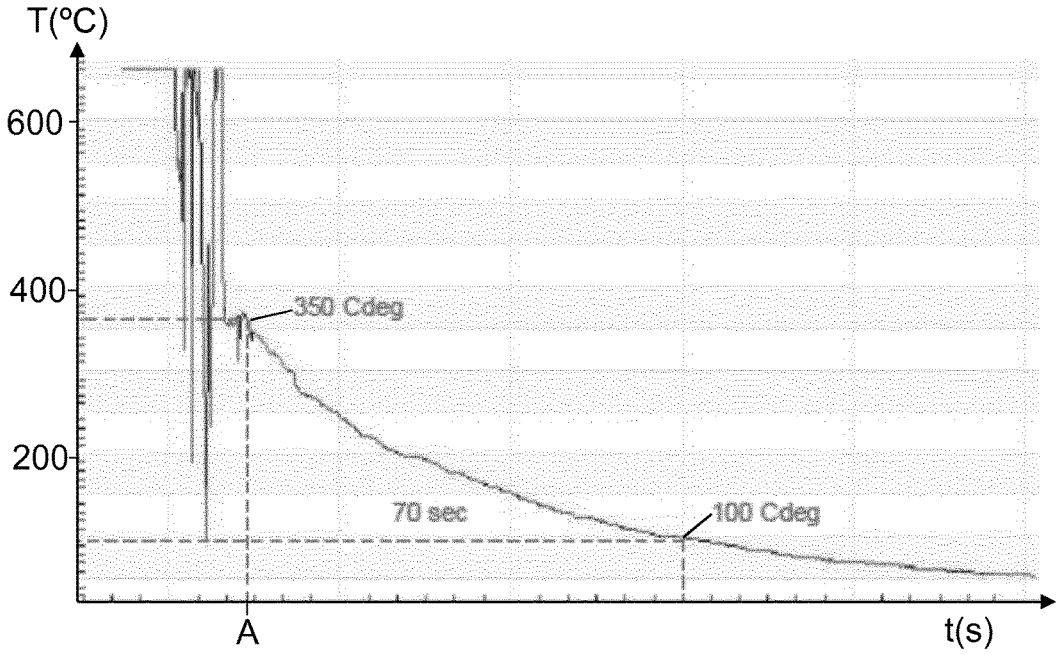
FIGS. 9A and 9B show graphs of temperature against time for a second example smoking article according to the invention.
Figure 9B:
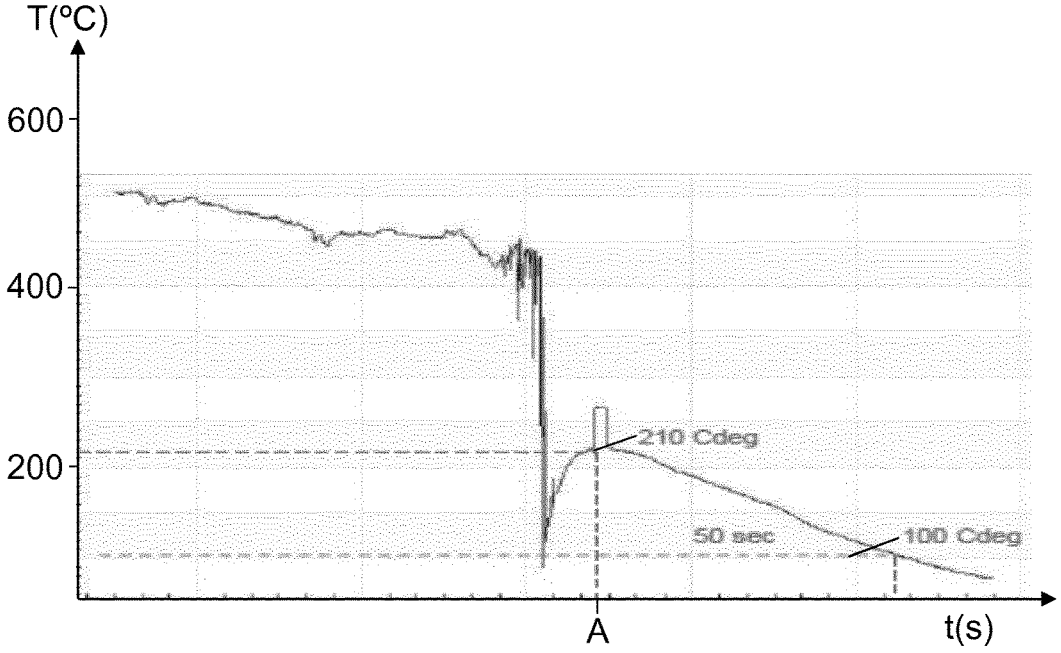

As shown in FIGS. 9A and 9B, the temperature of the combustible heat source upon lighting was above 700 degrees Celsius and outside of sensitivity range of camera. The temperature of the combustible heat source after 12 puffs was about between 400 and 450 degrees Celsius. In both tests a sharp decrease in temperature of the smoking article was observed upon sliding the extinguisher from first to second position at time A. In the first test, the temperature of the heat source dropped to 100 degrees Celsius within 70 seconds upon sliding the tubular element to the second position. In the second test, the temperature of the heat source dropped to 100 degrees Celsius within 50 seconds upon sliding the tubular element to the second position.

The specific embodiments and examples described above illustrate but do not limit the invention. It is to be understood that other embodiments of the invention may be made and the specific embodiments and examples described herein are not exhaustive.

The invention claimed is:

1. A smoking article having a proximal end and a distal end, comprising:

a combustible heat source disposed at the distal end of the smoking article;

an aerosol-forming substrate disposed downstream of the combustible heat source;

a mouthpiece disposed downstream of the aerosol-forming substrate and at the proximal end of the smoking article; and a tubular element, which is slideable from a first position towards the distal end of the smoking article to a second position, wherein, in the second position, the tubular element at least partially extends over the combustible heat source, and wherein the tubular element is lined with a heat reactive material configured to deform in response to heat from the combustible heat source when the tubular element is in the second position, the heat reactive material comprising an intumescent material configured to expand in response to heat and to restrict a supply of air to the combustible heat source when the tubular element is in the second position.

2. The smoking article according to claim 1, wherein the tubular element is configured to have a frictional fit between the inner surface of the tubular element and the outer surface of the smoking article.

3. The smoking article according to claim 1, wherein, in the second position, the tubular element extends along substantially an entire length of the combustible heat source.

4. The smoking article according to claim 1, wherein, in the second position, the tubular element extends past a distal end of the combustible heat source.

5. The smoking article according to claim 1, the tubular element being further lined with a non-combustible material.

6. The smoking article according to claim 5, the non-combustible material being at least one material chosen from a metal, a metal oxide, a ceramic, and a stone.

7. The smoking article according to claim 6, the non-combustible material being aluminium.

8. The smoking article according to claim 1, the tubular element further comprising an insulating material.

9. The smoking article according to claim 1, further comprising a plurality of air inlets configured so that air drawn through the aerosol-forming substrate enters the smoking article through the plurality of air inlets, and wherein the tubular element is substantially slideable from the first position to the second position so that a resistance to draw of the smoking article is controllable by selectively covering one or more air inlets of the plurality of air inlets.

10. The smoking article according to claim 9, wherein the tubular element comprises at least one air inlet of the plurality of air inlets.

11. The smoking article according to claim 1, wherein an inner surface of the tubular element comprises at least one protrusion configured so that, when the tubular element is in the second position, the at least one protrusion resists movement of the tubular element towards the proximal end of the smoking article.

12. The smoking article according to claim 11, wherein the at least one protrusion comprises a folded flap disposed at a distal end of the tubular element, the folded flap extending at least partially towards the proximal end of the smoking article.

13. The smoking article according to claim 1, wherein the combustible heat source is a carbonaceous combustible heat source.

* * * * *